United States Patent [19]

Penner

[11] Patent Number: 4,669,383

[45] Date of Patent: Jun. 2, 1987

[54] PROPELLANT CHARGE IGNITER

[75] Inventor: Horst Penner, Fürth, Fed. Rep. of Germany

[73] Assignee: Dynamit Nobel Aktiengesellschaft, Troisdorf, Fed. Rep. of Germany

[21] Appl. No.: 731,390

[22] Filed: May 7, 1985

[30] Foreign Application Priority Data

May 7, 1984 [DE] Fed. Rep. of Germany ..... 3416736

[51] Int. Cl.[4] ..... F42C 19/08

[52] U.S. Cl. ..... 102/202; 102/204

[58] Field of Search ..... 102/202, 204, 205, 470, 102/430, 431, 373

[56] References Cited

U.S. PATENT DOCUMENTS 4,492,167 1/1985 Brede et al. ..... 102/204

FOREIGN PATENT DOCUMENTS 2343987 3/1976 France ..... 102/470

1231486 12/1966 Netherlands .

*Primary Examiner*—Deborah L. Kyle

*Assistant Examiner*—Michael J. Carone

*Attorney, Agent, or Firm*—Antonelli, Terry & Wands

[57] ABSTRACT

A propellant charge igniter is equipped with an igniter tube having bores for connecting with a pressure chamber with a propellant charge, and with a column of annular tablets in the igniter tube serving as the igniter charge. The annular tablets consist, in this arrangement, of an annular base member carrying on at least one end face a shoulder of a smaller wall thickness than the base member wherein the outer diameter of the shoulder is at most as large as the outer diameter of the base member. The shoulders comprise recesses connecting a bore defined by the column of annular tablets and an outer chamber formed by the shoulders and the igniter tube.

6 Claims, 3 Drawing Figures

PROPELLANT CHARGE IGNITER

This invention relates to a propellant charge igniter having an igniter tube with bores for connecting with a pressure chamber containing a propellant charge and a column of annular tablets forming the igniter charge.

The efficiency of a gun depends essentially on the kinetic energy of the fired projectiles, especially if subcaliber hard-core projectiles are involved. The muzzle energy of the projectiles depends on the quantity of propellant charge powder driving the projectile. Without a change in the dimensions of the cartridge case, determined by the gun utilized, this factor leads necessarily to increased charge densities of the propellant charge powder and, thus, to a more difficult ignition thereof. In such propellant charges, conventional propellant charge igniters can produce catastrophic pressure conditions because the amount of the ignition gases entering the propellant charge from the propellant charge igniter encounters only a substantially reduced vacant volume. The ignition gases, which are under pressure, cannot expand sufficiently quickly due to the missing space and also due to an increased throttling effect of the propellant charge powder grains which, in this arrangement, are more densely packed. As a consequence, local excess pressure conditions are produced in the ignition phase, the powder grains are subjected to great mechanical stresses, and, in certain cases, the gas pressure for which the weapon is designed is exceeded. The amount of ignition gases cannot be reduced because it is not only necessary to still provide the heretofore required ignition energy, but that energy must actually even be increased on account of the increase in propellant charge density.

The structure of a propellant charge igniter of a conventional type wherein the above-discussed problems arise and which is known substantially, for example, from DOS 3,226,269, will be described below with reference to FIG. 1. The propellant charge igniter consists of an outer member 1 with an igniter element 2 arranged therein and with an igniter tube 3 inserted in the outer member 1 by way of a sealing compound 4. In the igniter tube 3, the column of annular tablets 6, held by a shrink-fitted hose 7, is arranged and fixed in position by way of a spacer tube 5, rings 8 and 9, and another spacer tube 10 and a locking screw 11. The igniter tube 3 has bores 12 in the region of the tablet column. The column of annular tablets 6 (booster charge) is the element creating the hot ignition gases during its deflagration; these gases then pass into the propellant charge (not shown) through the bores 12 of the igniter tube 3 and ignite this charge. However, the booster charge proper impedes this flow because the annular tablet column is set on fire; i.e., ignited from the inside. The tablets burn through only after a relatively long period of time and vacate passage for the ignition gas. However, at this point in time, the internal pressure in the propellant charge igniter has risen greatly, and the ignition gases are already under a damagingly high pressure while passing through the bores 12 of the igniter tube 3.

Starting with the above-described state of the art, it is an object of the present invention to design a propellant charge igniter in such a way that critical stresses of the propellant charge are avoided, and the charge is safely ignited.

This object has been attained by providing that the annular tablets each consists of a ring-shaped base member carrying on at least one of its end faces a shoulder of a smaller wall thickness, the outer diameter of this shoulder corresponding at most to the outer diameter of the base member.

By employing annular tablets of this construction, the problems of ignition of power-boosted ammunition are avoided since the ignition process is slowed down by reducing the gas rate supplied by the propellant charge igniter in such a way that critical stresses of the propellant charge are safety avoided. By virtue of the fact that the shoulder or shoulders on the base member exhibit a smaller wall thickness than the base member proper, the internal pressure within the column of annular tablets rises steeply only until, by deflagration of the shoulders, communication paths are opened up between the inner space of the column of tablets and the bores in the igniter tube. From this point in time on, the pressure is lowered so that the tablets deflagrate at a lower speed, and the propellant charge is ignited gently. Preferably, the shoulders are formed on both end faces of the base members.

In a preferred embodiment, the shoulders have the same inner diameter as, but a smaller outer diameter than the base members. Thereby the gases can continue to expand, after burning through of the shoulders, in the free annular spaces between the inner wall of the igniter tube and the outer walls of the tablet sets (or column), whereby the pressure is once more reduced and ignition is made more uniform and gentler.

In an especially preferred embodiment of the present invention, the shoulders exhibit recesses connecting the bore of the annular tablet and an outer space or chamber. In this embodiment, the ignition gases are not accumulated exclusively in the inner volume of the column, but rather are conducted, right from the beginning of generation, immediately through the recesses and the bores toward the outside into the propellant charge. For this reason, there is no substantial rise in pressure in the interior of the propellant charge igniter. Furthermore, the deflagration velocity of the tablets is thereby initially lowered on account of the lower internal pressure so that the ignition process acts with a very long duration. Since the high internal pressure has thus been eliminated, it can no longer happen, either, that the tablets are crushed, as heretofore occurred, and uncombusted fragments pass through the bores of the igniter tube into the propellant powder charge where they act uncontrollably.

In order to ensure that the annular tablets can be stacked accurately, which is of extreme importance for the fashioning of the propellant charge igniter, the width of the recesses are advantageously selected to be smaller than the width of the remaining portions of the shoulders. This ensures that even if the annular tablets are stacked without special mutual orientation, there cannot occur any "meshing" of the annular tablets and, as a result, any uncontrollable change in cross section of the recesses.

Advantageously, the total height of the annular tablets is chosen in correspondence with the spacing between the bores in the longitudinal direction of the igniter tube, it being especially advantageous to locate, within the height of each shoulder, at least one bore in the igniter tube.

Preferred embodiments of the present invention will be described in greater detail below with reference to the drawings wherein.

Figure 1:
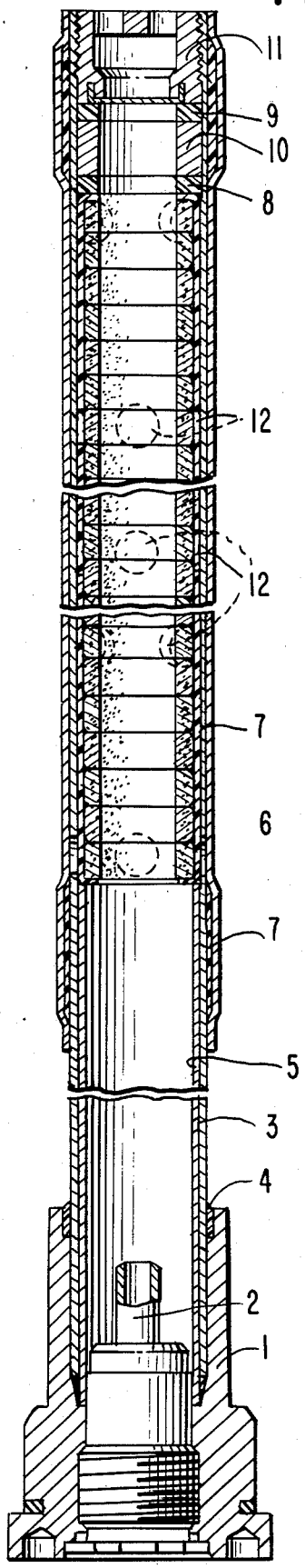
FIG. 1 shows a conventional propellant charge igniter in a longitudinal sectional view.
Figure 2:
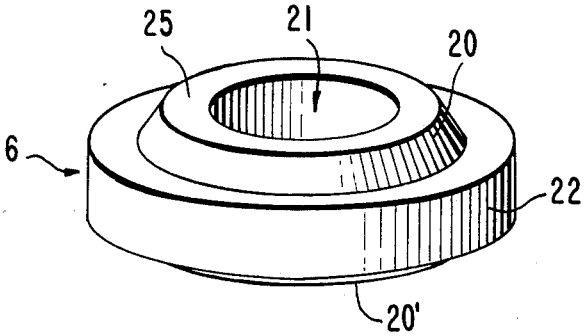
FIG. 2 shows a perspective view of a preferred embodiment of one of the annular tablets.

The annular tablet 6 shown in FIG. 2, which consists of a conventional initiator mixture, for example boron potassium nitrate, has an essentially ring-shaped base member 22, shoulders 20, 20' being arranged on the two end faces thereof. The shoulders 20, 20' have the same inner diameter as the annular base member 22. The end face 25 of each of the shoulders 20, 20' exhibits a substantially smaller outer diameter than the base member 22 while the outer diameter of the shoulders 20, 20' at the transition zone into the base member 22 is widened with respect to that of the end face. On account of this conical configuration of the shoulders 20, 20', an especially high mechanical stability of the entire annular tablet 6 is obtained, and the annular space produced during stacking between the tablets 6 and the inner wall of the igniter tube 3 is effectively expanded. Moreover, during deflagration, the gap between the inner space 21 and the outer space formed between the igniter tube and of the tablet column opens up only gradually so that there cannot be any pressure surges.

Figure 3:
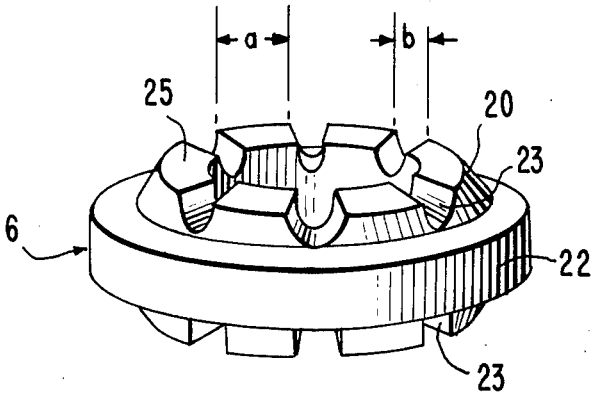
FIG. 3 shows another preferred embodiment of an annular tablet.

In the preferred embodiment of the present invention shown in FIG. 3., the shoulders 20, 20' are provided with recesses 23 connecting the inner space 21 of the tablets 6 with the outer space or chamber. The shoulders thus convey the image of the top of a wall with battlements, the cross section of the recesses 23 advantageously being essentially semicircular in shape. In order to make the tablets 6 still amenable to stacking, the width b of the recesses is preferably chosen to be smaller than the width a of the remaining portions of the shoulders 20, 20'. In this way, it cannot happen that, during stacking, the remaining portions of the shoulders lock into the recesses and seal the recesses at least partially in an uncontrollable fashion.

It is, of course, possible to arrange a shoulder 20 or 20' only unilaterally on a base member 22 and to make the shoulders straight, inclined, or curved, rather than conical. It is likewise, of course, possible to shape the recesses or grooves to be of angular or some other configuration. Furthermore, the inner diameter of the shoulders can be selected to be different from that of the cylindrical portion. Such constructions are less preferred than those shown in FIGS. 2 and 3.

What is claimed is:

1. A propellant charge igniter with an igniter tube with bores for connecting with a pressure chamber containing a propellant charge, and with a column of annular tablets forming an igniter charge, characterized in that the annular tablets each consists of a ring-shaped base member carrying on at least one end face a shoulder of a smaller wall thickness, the outer diameter of this shoulder corresponding at most to the outer diameter of the base member; the shoulders having recesses connecting a bore defined by the column of the annular tablets and an outer chamber formed by the shoulders and the igniter tube.

2. A propellant charge igniter according to claim 1, characterized in that the shoulders exhibit the same inner diameter as, but a smaller outer diameter than the base member, the outer diameter of the shoulders widening conically in a direction toward the base member.

3. A propellant charge igniter according to claim 1, characterized in that the width (a) of each of the remaining portions of the shoulders is larger than the width (b) of each of the recesses.

4. A propellant charge igniter according to claim 1, characterized in that the total height of the annular tablets corresponds to an even-numbered fraction of the spacing between the bores in the longitudinal direction of the igniter tube.

5. A propellant charge igniter according to claim 1, characterized in that shoulders are formed on both end faces of the base member.

6. A propellant charge igniter according to claim 5, characterized in that the shoulders exhibit the same inner diameter as, but a smaller outer diameter than the base member, the outer diameter of the shoulders widening conically in a direction toward the base member.

* * * * *